US008939434B2

(12) United States Patent
Selby

(10) Patent No.: US 8,939,434 B2
(45) Date of Patent: Jan. 27, 2015

(54) METHOD AND DEVICE FOR REMOVAL OF VERTICAL MANWAY COVER

(76) Inventor: Timothy Selby, Evansville, IN (US)

( * ) Notice: Subject to any disclaimer, the term of this patent is extended or adjusted under 35 U.S.C. 154(b) by 398 days.

(21) Appl. No.: 13/507,049

(22) Filed: May 31, 2012

(65) Prior Publication Data

US 2012/0317799 A1 Dec. 20, 2012

Related U.S. Application Data

(60) Provisional application No. 61/520,712, filed on Jun. 14, 2011.

(51) Int. Cl.

| | |
|---|---|
| ***B66F 5/02*** | (2006.01) |
| ***B66F 19/00*** | (2006.01) |
| ***B66F 9/065*** | (2006.01) |
| ***B66F 9/075*** | (2006.01) |
| ***F22B 37/00*** | (2006.01) |

(52) U.S. Cl.

CPC ..... *B66F 19/005* (2013.01); *B66F 9/065* (2013.01); *B66F 9/07522* (2013.01); *B66F 9/0655* (2013.01); *F22B 37/00* (2013.01)

USPC ..... 254/2 B

(58) Field of Classification Search

CPC ..... B66F 19/005; B66C 23/48; B66C 23/485; Y10S 212/901; Y10S 254/16

USPC .... 254/2 B, 2 R, 3 R, 3 B, 3 C, 7 R, 7 B, 7 C, 254/8 R, 9 R, 9 B, 9 C, 8 B, 13, 14, 131; 212/261, 294; 269/17, 57

See application file for complete search history.

(56) References Cited

U.S. PATENT DOCUMENTS

| | | | | | |
|---|---|---|---|---|---|
| 686,425 | A | * | 11/1901 | Sommerfeld | 5/86.1 |
| 795,524 | A | * | 7/1905 | Leffmann | 5/89.1 |
| 1,295,463 | A | * | 2/1919 | Flair | 269/17 |
| 2,263,871 | A | * | 11/1941 | Duffy | 254/100 |
| 2,528,329 | A | * | 10/1950 | Bauer | 254/124 |
| 2,846,259 | A | * | 8/1958 | Sadler | 294/15 |
| 2,851,247 | A | * | 9/1958 | Hilding | 254/8 B |
| 2,903,238 | A | * | 9/1959 | Flandrick | 254/124 |
| 2,985,142 | A | * | 5/1961 | Aiken | 91/436 |
| 2,988,330 | A | * | 6/1961 | Allison | 254/98 |
| 3,059,785 | A | * | 10/1962 | Buckeye | 414/728 |
| 3,152,708 | A | * | 10/1964 | Agesen | 414/449 |
| 3,154,290 | A | * | 10/1964 | Johnson | 254/8 C |
| 3,185,422 | A | * | 5/1965 | Spindler | 248/125.1 |
| 3,222,029 | A | * | 12/1965 | Hildemann | 254/8 R |
| 3,263,822 | A | * | 8/1966 | Weinman | 212/301 |
| 3,275,296 | A | * | 9/1966 | Meyer | 254/8 R |
| 3,275,299 | A | * | 9/1966 | Meshew | 254/131 |
| 3,303,940 | A | * | 2/1967 | Valla | 212/288 |

(Continued)

*Primary Examiner* — Lee D Wilson
*Assistant Examiner* — Jamal Daniel
(74) *Attorney, Agent, or Firm* — Gary K. Price

(57) ABSTRACT

A lift for maneuvering a heavy manway cover, the lift including a wheeled base and a generally horizontal arm connectable to the cover. A pair of spaced lifts connecting the arm to the base and a shaft rotatably held within the arm. A wheel crank connected to the shaft to rotate the shaft in a pivotable connection on the end of the shaft. Wherein the shaft having a first position wherein the cover is held against rotation and a second position wherein the weight of the cover allows the cover to pivot under the shaft while an axis of the cover rotates from being perpendicular to the arm to being parallel to the arm.

20 Claims, 9 Drawing Sheets

(56) References Cited

U.S. PATENT DOCUMENTS

| | | | | | |
|---|---|---|---|---|---|
| 3,337,187 | A | * | 8/1967 | Sumner | 254/387 |
| 3,362,684 | A | * | 1/1968 | Davenport | 254/131 |
| 3,367,512 | A | * | 2/1968 | Kaplan | 212/294 |
| 3,521,860 | A | * | 7/1970 | Zehrung, Jr. et al. | 254/8 R |
| 3,599,812 | A | * | 8/1971 | Hasstedt et al. | 414/563 |
| 3,627,157 | A | * | 12/1971 | Blatchly | 414/460 |
| 3,667,632 | A | * | 6/1972 | Tidswell | 414/680 |
| 3,797,675 | A | * | 3/1974 | Moore | 414/560 |
| 3,811,576 | A | * | 5/1974 | Fagen | 212/289 |
| 3,837,622 | A | * | 9/1974 | Gale | 254/131 |
| 3,861,649 | A | * | 1/1975 | Mosley | 254/124 |
| 3,866,759 | A | * | 2/1975 | Lucas | 212/261 |
| 3,931,956 | A | * | 1/1976 | Hawkins | 254/8 B |
| 3,985,338 | A | * | 10/1976 | Herrmann | 254/131 |
| 4,021,017 | A | * | 5/1977 | Adams | 254/8 B |
| 4,029,308 | A | * | 6/1977 | Mathers | 269/17 |
| 4,076,217 | A | * | 2/1978 | Haller et al. | 254/131 |
| 4,090,625 | A | * | 5/1978 | Walters | 414/743 |
| 4,144,973 | A | * | 3/1979 | Reale | 212/257 |
| 4,157,809 | A | * | 6/1979 | Haller et al. | 254/131 |
| 4,157,810 | A | * | 6/1979 | Haller et al. | 254/131 |
| 4,190,233 | A | * | 2/1980 | Godfrey | 254/4 B |
| 4,321,003 | A | * | 3/1982 | Castle | 414/440 |
| 4,360,187 | A | * | 11/1982 | Chapman | 254/8 R |
| 4,365,925 | A | * | 12/1982 | Girtz | 414/684.3 |
| 4,479,632 | A | * | 10/1984 | McIntire et al. | 254/3 B |
| 4,482,182 | A | * | 11/1984 | Mortensen | 294/15 |
| 4,488,706 | A | * | 12/1984 | Kono | 254/131 |
| 4,490,088 | A | * | 12/1984 | Castle | 414/457 |
| 4,497,469 | A | * | 2/1985 | Barnhouse | 254/8 B |
| 4,508,233 | A | * | 4/1985 | Helms | 212/294 |
| 4,512,554 | A | * | 4/1985 | Racine | 254/131 |
| 4,533,127 | A | * | 8/1985 | Hawkins | 269/17 |
| 4,653,728 | A | * | 3/1987 | Mochizuki et al. | 254/131 |
| 4,662,607 | A | * | 5/1987 | Mochizuki et al. | 254/131 |
| 4,669,703 | A | * | 6/1987 | Hawkins et al. | 254/8 B |
| 4,691,904 | A | * | 9/1987 | Armstrong | 269/17 |
| 4,705,264 | A | * | 11/1987 | Hawkins et al. | 269/17 |
| 4,789,072 | A | * | 12/1988 | Quam et al. | 212/166 |
| 4,826,388 | A | * | 5/1989 | Golding | 414/684.3 |
| 4,852,855 | A | * | 8/1989 | Moisan | 254/131 |
| 4,899,986 | A | * | 2/1990 | Tweedy | 254/8 B |
| 4,925,039 | A | * | 5/1990 | Macris | 212/294 |
| 4,978,103 | A | * | 12/1990 | Moisan | 254/131 |
| 4,991,893 | A | * | 2/1991 | Gordon et al. | 294/17 |
| 5,011,364 | A | * | 4/1991 | Anderson | 414/694 |
| 5,035,336 | A | * | 7/1991 | Schmitz et al. | 212/166 |
| 5,037,068 | A | * | 8/1991 | Grottesi | 254/8 B |
| 5,064,334 | A | * | 11/1991 | Cooley | 414/428 |
| 5,070,564 | A | * | 12/1991 | Fey | 7/170 |
| 5,076,448 | A | * | 12/1991 | Ballard | 212/294 |
| 5,082,127 | A | * | 1/1992 | Huang | 212/299 |
| 5,100,283 | A | * | 3/1992 | Carty | 414/590 |
| 5,165,661 | A | * | 11/1992 | Wright | 254/131 |
| 5,190,265 | A | * | 3/1993 | Barry et al. | 254/8 B |
| 5,203,540 | A | * | 4/1993 | Lee | 254/8 B |
| 5,251,875 | A | * | 10/1993 | Craychee et al. | 254/8 B |
| 5,261,640 | A | * | 11/1993 | Yuan | 254/8 B |
| 5,382,131 | A | * | 1/1995 | Werthmann | 414/684.3 |
| 5,462,385 | A | * | 10/1995 | Mohlengraft | 404/25 |
| 5,549,287 | A | * | 8/1996 | Loucks | 269/17 |
| 5,556,148 | A | * | 9/1996 | Skinner | 294/67.1 |
| 5,713,559 | A | * | 2/1998 | McClarin et al. | 254/124 |
| 5,897,100 | A | * | 4/1999 | Napier et al. | 254/8 B |
| 5,897,101 | A | * | 4/1999 | Snyder | 254/8 B |
| 5,993,106 | A | * | 11/1999 | Huang | 404/26 |
| 6,053,476 | A | * | 4/2000 | Chapman | 254/8 R |
| 6,073,913 | A | * | 6/2000 | Chapman | 254/8 R |
| 6,170,802 | B1 | * | 1/2001 | Stovall | 254/8 B |
| 6,176,469 | B1 | * | 1/2001 | Bigham | 254/131 |
| 6,189,864 | B1 | * | 2/2001 | Crow et al. | 254/8 B |
| 6,202,985 | B1 | * | 3/2001 | Chong et al. | 254/131 |
| 6,202,986 | B1 | * | 3/2001 | Goldman | 254/131 |
| 6,276,665 | B1 | * | 8/2001 | Hawkins et al. | 254/8 B |
| 6,276,732 | B1 | * | 8/2001 | Hauss | 294/16 |
| 6,431,523 | B2 | * | 8/2002 | Goldman | 254/1 |
| 6,439,628 | B1 | * | 8/2002 | Eslambolchi et al. | 294/17 |
| 6,457,700 | B1 | * | 10/2002 | Hong | 254/8 B |
| 6,463,886 | B1 | * | 10/2002 | Rodden et al. | 119/728 |
| 6,485,001 | B1 | * | 11/2002 | Mallery et al. | 254/8 B |
| 6,491,293 | B1 | * | 12/2002 | Brewer | 269/17 |
| 6,520,482 | B1 | * | 2/2003 | Bigham | 254/131 |
| 6,533,260 | B1 | * | 3/2003 | Mock | 269/17 |
| 6,581,908 | B1 | * | 6/2003 | Francis | 254/2 B |
| 6,595,566 | B1 | * | 7/2003 | Donnan | 294/16 |
| 6,612,548 | B2 | * | 9/2003 | Landreth et al. | 254/8 R |
| 6,964,407 | B1 | * | 11/2005 | Butler | 254/131 |
| 7,080,823 | B1 | * | 7/2006 | Triplett | 254/8 B |
| 7,225,482 | B2 | * | 6/2007 | Brooks | 5/83.1 |
| 7,243,906 | B2 | * | 7/2007 | Pagliarani | 254/8 B |
| 7,293,759 | B2 | * | 11/2007 | Beach et al. | 254/131 |
| 7,371,039 | B2 | * | 5/2008 | Doeden | 414/589 |
| 7,387,463 | B2 | * | 6/2008 | Winn, Jr. | 404/73 |
| 7,428,759 | B2 | * | 9/2008 | Bain et al. | 5/86.1 |
| 7,429,035 | B2 | * | 9/2008 | Metcalf et al. | 269/71 |
| 7,503,743 | B1 | * | 3/2009 | Friedrich | 414/684.3 |
| 7,544,035 | B1 | * | 6/2009 | Friedrich | 414/684.3 |
| 7,731,451 | B2 | * | 6/2010 | Roberts | 404/86 |
| 8,043,041 | B1 | * | 10/2011 | Neeley et al. | 414/684.3 |
| 8,434,737 | B2 | * | 5/2013 | Zhou | 254/8 B |
| 8,474,794 | B2 | * | 7/2013 | Liljedahl | 254/120 |
| 8,646,628 | B2 | * | 2/2014 | Martin | 212/197 |
| 2002/0179891 | A1 | * | 12/2002 | Schuller et al. | 254/131 |
| 2003/0085390 | A1 | * | 5/2003 | Bigham | 254/131 |
| 2003/0167567 | A1 | * | 9/2003 | Reed | 5/86.1 |
| 2004/0232395 | A1 | * | 11/2004 | Brooks | 254/8 R |
| 2004/0232396 | A1 | * | 11/2004 | Ming-Hwa | 254/8 R |
| 2005/0006631 | A1 | * | 1/2005 | Ming-Hwa | 254/8 R |
| 2006/0208240 | A1 | * | 9/2006 | Spittle et al. | 254/8 B |
| 2006/0284144 | A1 | * | 12/2006 | Pagliarani | 254/8 B |
| 2007/0228346 | A1 | * | 10/2007 | Beach et al. | 254/131 |
| 2008/0159810 | A1 | * | 7/2008 | Myers | 404/83 |
| 2008/0217277 | A1 | * | 9/2008 | Spitsbergen | 212/179 |
| 2008/0308692 | A1 | * | 12/2008 | Cheng et al. | 248/188.8 |
| 2009/0101876 | A1 | * | 4/2009 | Takahashi | 254/14 |
| 2009/0134106 | A1 | * | 5/2009 | Martin | 212/196 |
| 2009/0304488 | A1 | * | 12/2009 | Becker et al. | 414/739 |
| 2010/0224841 | A1 | * | 9/2010 | Liljedahl | 254/120 |
| 2011/0043062 | A1 | * | 2/2011 | Lorenzen | 310/83 |
| 2011/0133140 | A1 | * | 6/2011 | Shepherd | 254/131 |
| 2012/0027559 | A1 | * | 2/2012 | Farbos et al. | 414/800 |
| 2012/0112146 | A1 | * | 5/2012 | Zhou | 254/8 B |
| 2012/0317799 | A1 | * | 12/2012 | Selby | 29/822 |
| 2013/0168622 | A1 | * | 7/2013 | Liljedahl | 254/8 R |
| 2014/0083966 | A1 | * | 3/2014 | Juan Martin | 212/261 |

* cited by examiner

METHOD AND DEVICE FOR REMOVAL OF VERTICAL MANWAY COVER

CROSS REFERENCES TO RELATED APPLICATIONS

U.S. Provisional Application for Patent No. 61/520,712, filed Jun. 14, 2011, with title "Method and Device for Removal of Vertical Manway Cover" which is hereby incorporated by reference. Applicant claim priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

The present invention relates to a handling heavy equipment including steel manway doors.

2. Brief Description of Prior Art

It is common to provide lift equipment. But in inaccessible areas it is often still necessary to lift heavy objects via manual lifting. An example of manual lifting is moving manway covers (doors) on hemi-head style feedwater heaters. Currently these covers must be maneuvered by hand. These manway covers can weigh as much as 500 lbs. and handling them is a safety concern. The spaces covered by manway doors are sometimes considered to be confined spaces and as such present a significant safety hazard to the workers.

As will be seen from the subsequent description, the preferred embodiment for the present invention overcome shortcomings of this prior art.

SUMMARY OF THE INVENTION

Briefly stated, the present invention is directed to a device and method for the removal of manway covers (doors) such as might be used on feedwater heaters.

A lift for maneuvering a heavy manway cover is disclosed. The lift includes a wheeled base and a generally horizontal arm connected to the cover; a pair of spaced lifts connecting the arm to the base and a shaft rotatably held within the arm; a wheel crank connected to the shaft to rotate the shaft and a pivotable connection on an end of the shaft. The shaft has a first position wherein the cover is held against rotation, and a second position wherein the weight of the cover allows the cover to pivot under the shaft.

DESCRIPTION OF THE PREFERRED EMBODIMENT

Figure 1:
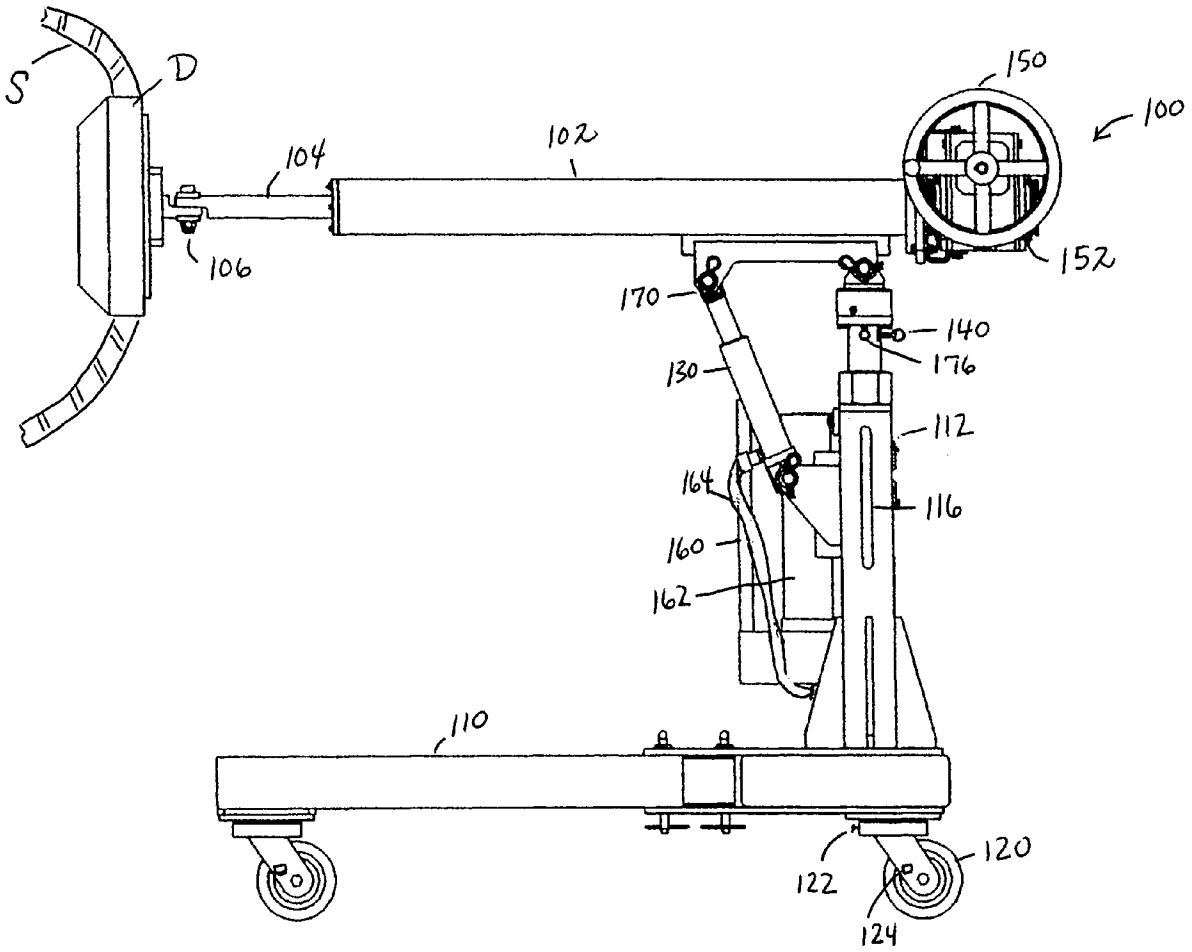
FIG. 1 shows a side view of the preferred embodiment of the present invention, a device for removal of vertical manway cover.
Figure 5A:
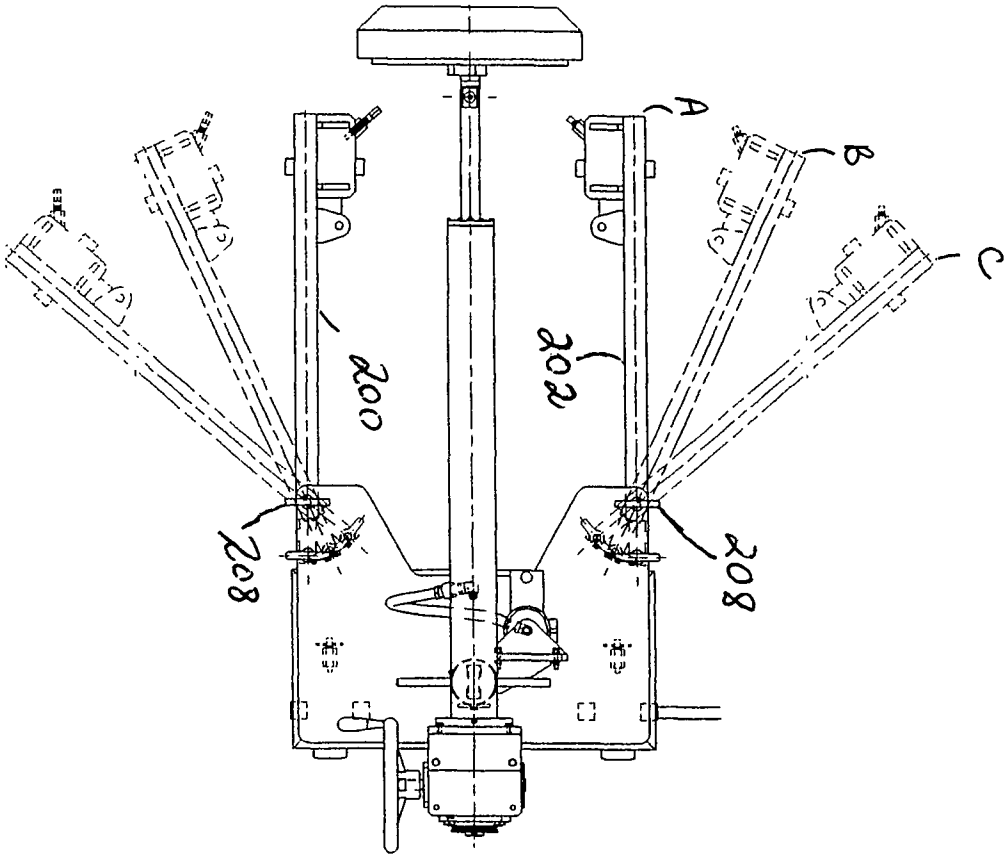
FIG. 5A shows an overhead view of the device in operation.
Figure 5B:
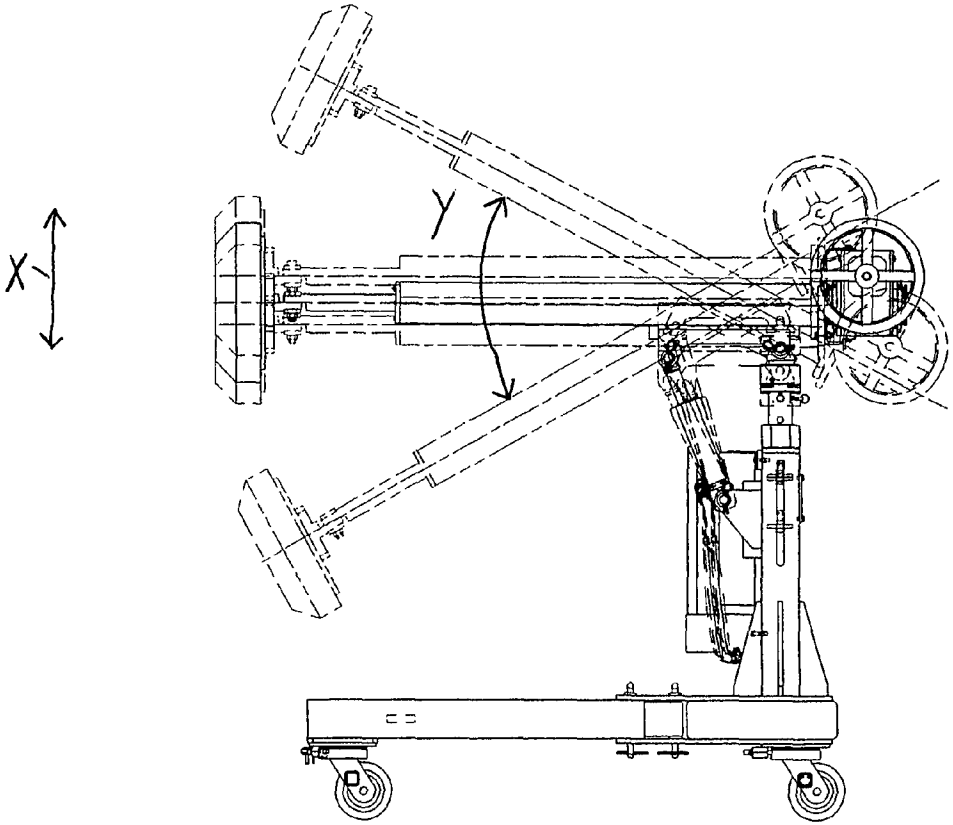
FIG. 5B shows a side view of the device in operation.

In accordance with the present invention, FIG. 1 shows a lift device 100. The lift device 100 is shown with a load such as a cover D from a manway that allows access into a space S such as a heater. The space S is shown with walls cut away and the cover D in place in the manway. The lift 100 includes an arm 102, such as a horizontal lift tube arm, and rotatable shaft 104. The rotatable shaft 104 includes a pivotable connection 106 that is boltable to the load such as cover D. The lift 100 includes a base 110 and an upright post 112 that has handles 116. The base 110 includes pivotable wheels 120 that allows a user to maneuver the base 110, each wheel 120 can include a lock 122. Each wheel 120 includes an attachment point such as opening 124 that allows for steering of the wheel 120. The lift 100 includes a drive link actuator such as a hydraulic cylinder 130 and a second drive link actuator such as screw lift 140. The hydraulic cylinder 130 and screw lift 140 act together as a pair to position the arm 102 through a range of positions as shown in FIG. 5*b*. The lift 100 includes a hand wheel crank 150 that controls the rotational position of shaft 104 and thereby the position of the load, cover D. The hand wheel crank 150 controls the shaft 104 through a geared transmission 152. The position of the cylinder 130 is controlled by a pump handle 160, pressure tank 162 and hose 164. The cylinder 130 is connected to the horizontal arm 102 at a pivot point 170. The rotational position of the screw 140 is controlled by bar 172 that inserts into openings 176.

Figure 2:
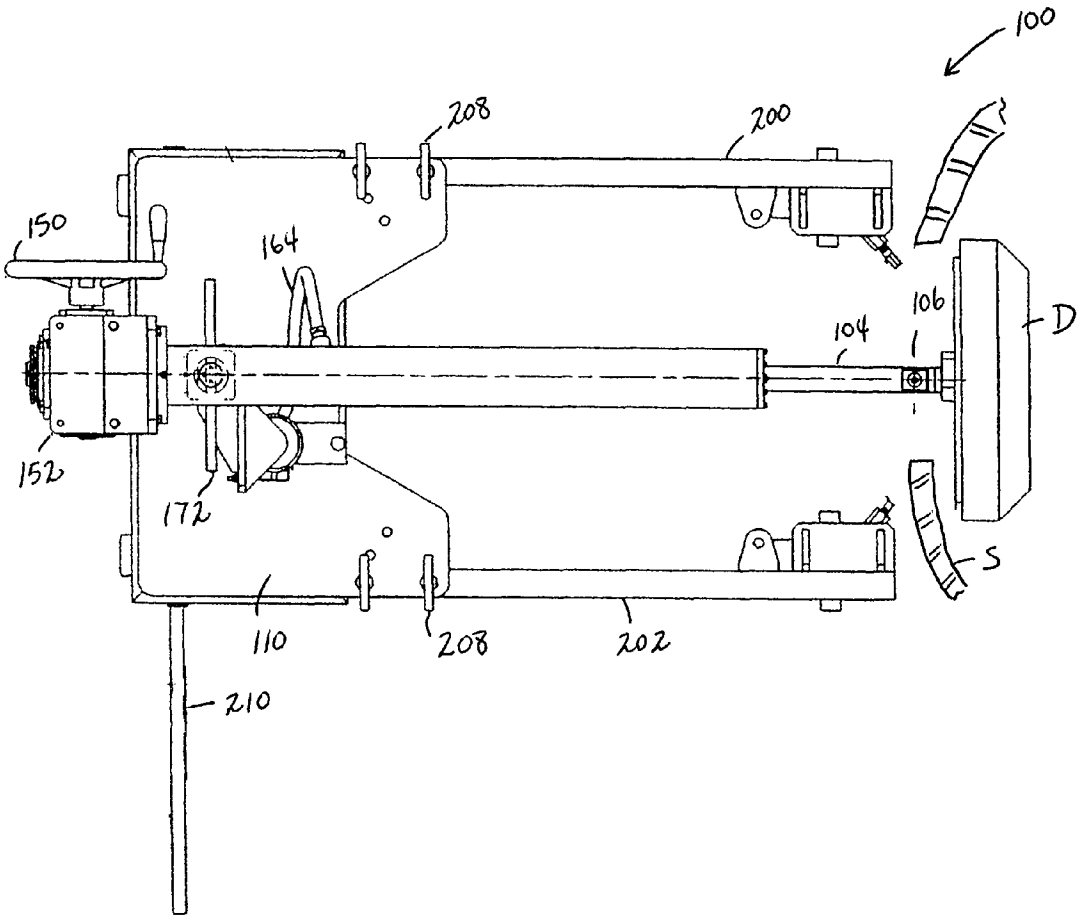
FIG. 2 shows an overhead view of the device of FIG. 1.

FIG. 2 shows a view of the lift 100 from above. The lift 100 includes a base 110 and the base 110 includes a pair of spaced legs 200 and 202. Each leg 200, 202 includes a pair of lock pins 208 that can lock legs 200, 202 in positions as shown in FIG. 5A. The lift 100 includes a bar 210 that engages opening 124 to steer each wheel 120. In FIG. 2 the cover D is in the process of being removed, once the cover D is detached it must first be pushed into the space S shown as cutaway walls in cross section. FIG. 2 shows that as the cover D is removed a significant pinch point develops between the wall of space S and the cover D.

Figure 3:
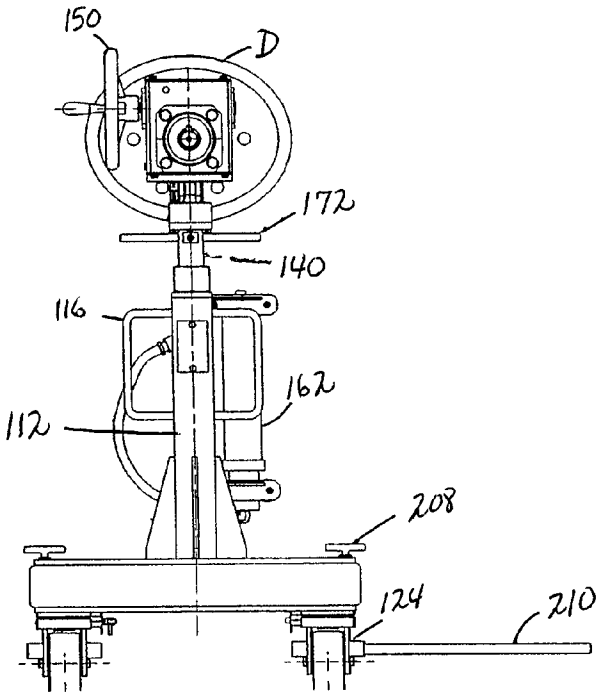
FIG. 3 shows an end view of the device of FIG. 1.

FIG. 3 shows a rear view of the lift 100 in use. This view shows a possible shape of manway cover D. The manway cover D can be a shape such as an oval with a long axis representing the width and a short axis representing the height, for example.

Figure 4A:
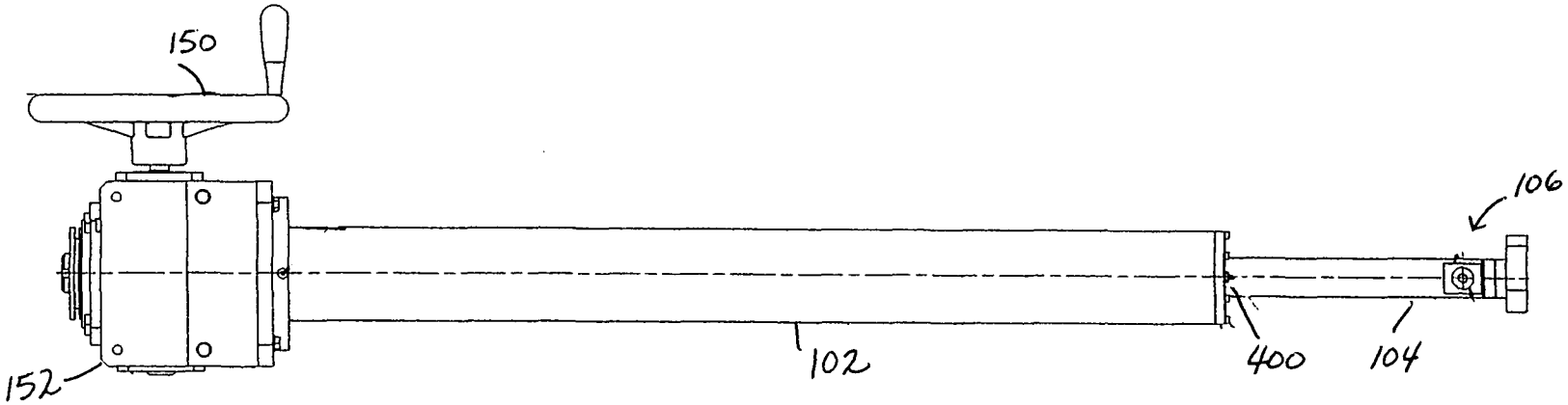
FIGS. 4A and 4B show details of the device.

FIG. 4*a* shows a view from above of details of the lift 100 with the base portion removed. The arm 102 holds a rotatable shaft 104 with bearings 400. The geared transmission 152 converts rotational movement of the hand wheel crank 150 into rotation of the shaft 104. The shaft includes a pivotable connection 106 that can pivot from the position shown in FIGS. 4*a* and 4*b* to the position shown in FIG. 6 with the cover in a vertical orientation under the shaft 104.

Figure 4B:
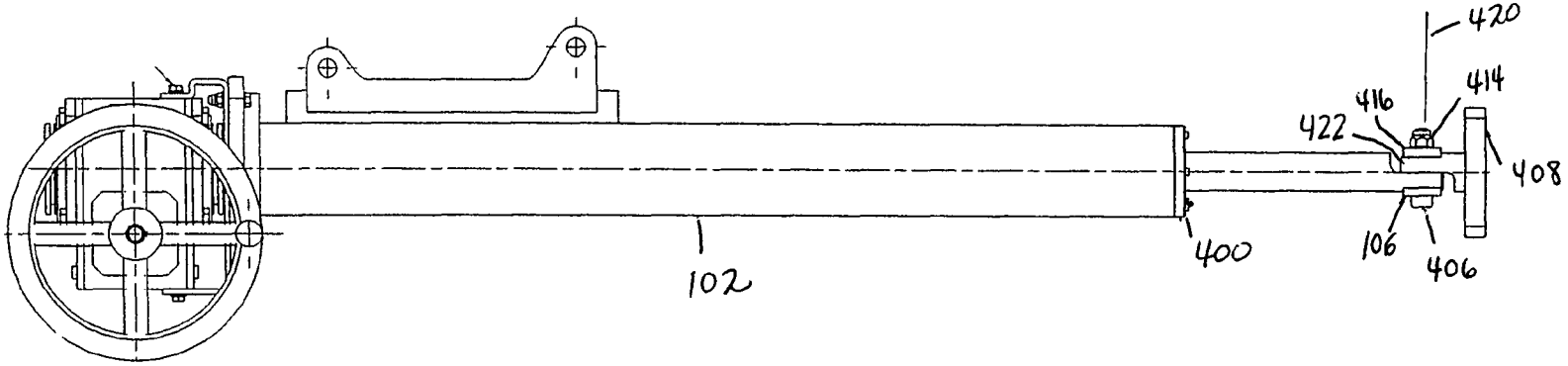

FIG. 4*b* shows a side view of the arm 102 and a joint such as pivot connection 106. The pivot connection 106 includes a pin 406 that connects a plate 408 to the end of the shaft 104. The pin 406 is threaded and is attached using a nut 414 and washer 416. The pin 406 forms a central axis 420 about which the plate 408 and any attached load D can pivot. The plate 408 is part of a coupling 422 having a flat surface that rests upon a flat surface of shaft 104. When the shaft 104 is rotated from the position shown in FIG. 4*b* to the position in FIG. 6 the weight of the load cover D will cause the plate 408 to pivot about the end of shaft 104 to the position in FIG. 6.

FIG. 5*a* shows a view of the lift 100 from above. The pins 208 can be removed and the legs 200, 202 can be positioned in any position A, B, C and the pins 208 replaced into holes in the base 110 to hold the legs 200, 202 in position. FIG. 5*b* shows a side view of the lift 100 and shows that the arm 102 can be moved through a range of upward and downward motions keeping the arm 102 level, this motion range is shown by arrow X. The arm 102 can also move through a range of angular motions shown by arrow Y.

Figure 6:
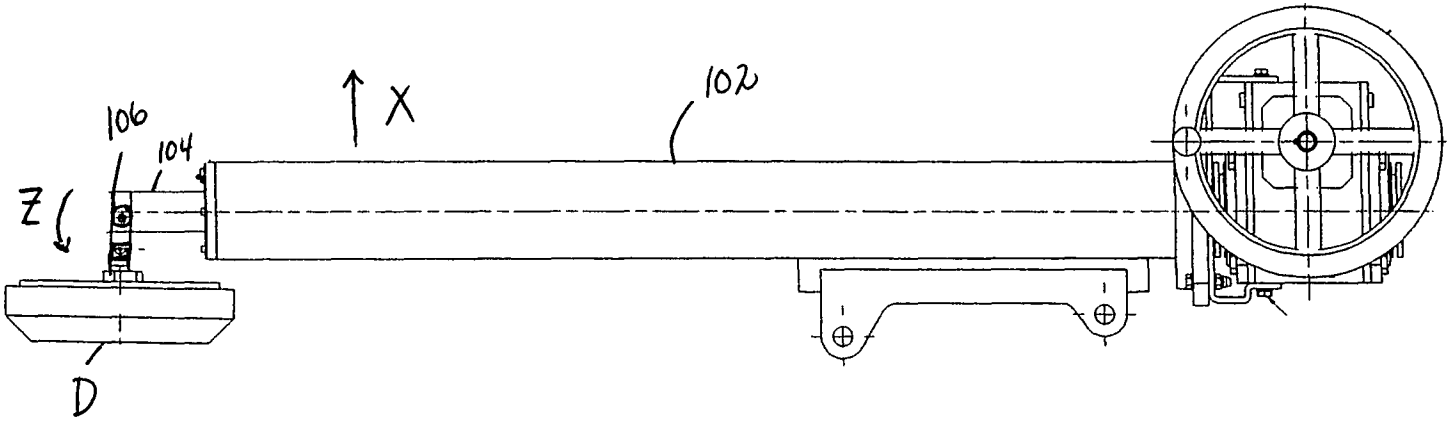
FIG. 6 shows further details of the device.

Arm 102 in an isolated view to show additional features. FIG. 6 shows that the cover D has pivoted from the unstable vertical position shown in FIG. 1 to a generally horizontal position of FIG. 6. The plate 408 rotates out of alignment with the axis of the arm 102 through an angle Z of approximately 90°.

Figure 7:
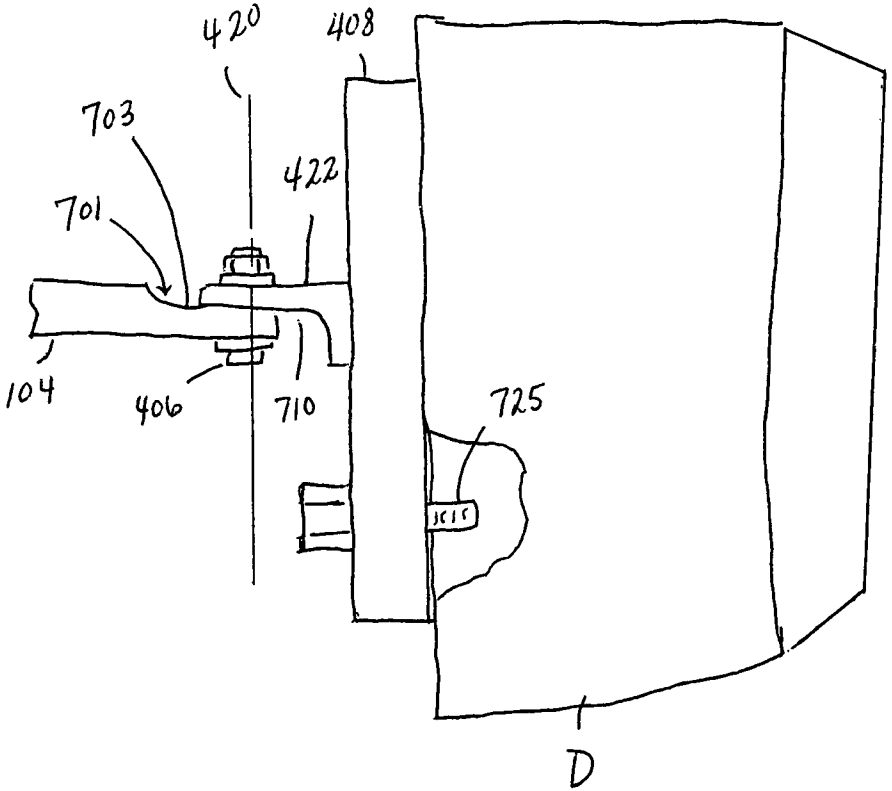
FIG. 7 shows a partial view of the device end shaft.

FIG. 7 shows a partial view of the end of shaft 104. The end of the cylindrical shaft 104 includes a clearance area 701 that creates a flat planer surface 703 that allows the coupling 422 to rotate relative to the shaft 104. The coupling 422 also includes a flat surface 710. The flat surface 703 of the cylinder 104 mates with the flat planer surface 710 of the coupling 422 and the flat surfaces are held together with pin 406 which forms a pinned planar connection having the central axis 420 about which the coupling 422 and cover D can rotate. The flat surfaces 703, 710 are held together with a pressure that forms a light friction fit joint. As the shaft 104 rotates from the position shown in FIGS. 1 and 7 to the position in FIG. 6 the coupling will at first rotate with the shaft 104 in a direction parallel to the shaft rotation about its own axis, but then the weight of the cover D will overcome the friction of the flat surfaces joint 703, 710 and the cover D will continue to rotate with the shaft 104 but will also rotate about the central axis 420. This controlled rotation allows a user to orient the cover D so that the long axis of the cover, which initially perpendicular to the arm 102, aligns with the arm 102 with the narrow width of the cover D presented to the opening. The coupling 422 includes fasteners such as screws 725 to attach the coupling 422 to the cover D.

In operation, the lift 100 is positioned and the coupling plate 408 can be attached to the cover D such as by bolting 725 the coupling plate 408 to the cover D. Then the cover D is released from the space walls S and in the case of the manway covers D on hemi-head style feedwater heaters, the cover D is pushed into the space S as shown in FIG. 2 by rolling the entire lift 100 toward the space S. The cover D is elongated as shown in FIG. 3 and is somewhat unstable in the vertical position shown in FIGS. 2 and 3. The next step is to turn the hand wheel crank 150 which rotates the shaft 104 and therefore the pivot connection 106 and the cover D. As the cover D rotates through 90 degrees the weight of the cover acts on the connection 106. As the connection turns through the same angle the cover D turns from the position shown in FIG. 3 first to a position where the long axis of the cover D is pointing nearly downward, then the connection 106 allows the weight of the cover D to pivot the connection 106 to the position shown in FIG. 6 with the plate 408 below the shaft 104. In the process of turning during removal, the cover D goes from a first position where the long axis of the cover D is perpendicular to the long axis of the arm 102 as shown in FIG. 1, to a second position where the cover D is under the arm 102 and the long axis of the cover D is parallel to the longitudinal axis of the arm 102. As can be seen in FIG. 6 it may be necessary to lift the cover D upward in direction X to get it out of the space S. The arm 102 can be lifted in a level orientation by turning the screw 140 with bar 172 and by lifting the arm 102 with cylinder 130. When the cover D is lifted to align with the opening in the space S it can be removed from the space by backing the lift 100 up.

In many cases there will be obstructions to moving the lift 100 and in such cases the legs 200, 202 can be positioned as shown in FIG. 5*a*. Once the cover D is off the space S an operator can enter the manway. Once work is complete the cover D can be replaced simply by reversing the steps used to remove it.

A key advantage of the invention is that it allows an operator to remove and replace the cover D without ever touching it. While replacing the cover D it may be necessary to lower the cover D, see lower position of cover D in FIG. 5*b* within the space S to get the weight of cover D to rotate about pinned planar connection 106 to go from position shown in FIG. 6 back to the original position shown in FIG. 1.

Although the description above contains many specificities, these should not be construed as limiting the scope of the invention but as merely providing illustrations of some of the presently preferred embodiments of this invention. Thus the scope of the invention should be determined by the appended claims in the formal application and their legal equivalents, rather than by the examples given.

I claim:

1. A lift for maneuvering a manway cover, the lift including:

a base having a plurality of wheels;

an arm adapted to connect to a manway cover;

a pair of spaced actuators connecting said arm to said base;

a shaft rotatably held within said arm;

a crank connected to said shaft to rotate said shaft;

a pivotable connection on an end of said shaft;

wherein said shaft having a first position wherein said cover is held against rotation and, a second position wherein the weight of said cover allows said cover to pivot under said shaft.

2. The lift as recited in claim 1, wherein the shaft includes a plate adapted to bolt to the manway cover and a joint connecting the plate to the shaft where the joint includes a pinned planar connection where rotation of the shaft about its long axis allows the weight of the manway cover to pivot about said pinned planar connection such that a first axis of said manway cover rotates from a first position perpendicular to a loop of said arm to a second position where said manway cover is under said arm and said first axis is parallel to said length of said arm.

3. The lift as recited in claim 1, wherein the base includes a pair of legs, each leg carrying a caster wheel and each leg being pivotable from a first position where a length of the leg is parallel to a length of said arm to a second position angled to said arm.

4. The lift as recited in claim 1, wherein said spaced actuators include a first actuator to lift and lower said arm and a second actuator to pivot said arm raising and lowering said manway cover.

5. The lift as recited in claim 1, wherein at least one of said plurality of wheels includes a steering means.

6. The lift as recited in claim 4, wherein said first actuator is a screw lift and said second actuator is a powered cylinder pivotally connected to said arm.

7. The lift as recited in claim 1, wherein said shaft location is controlled by a manual crank.

8. A lift for maneuvering a load, the lift including:

a wheeled base;

an arm adapted to connect to a load;

a pair of spaced actuators connecting said arm to said base;

a joint rotatably held by said arm;

a crank connected to said joint to rotate said joint;

a pivotable connection on an end of said joint;

wherein said joint having a first position wherein said load is held against rotation and, a second position wherein the weight of said load allows said load to pivot under said arm.

9. The lift as recited in claim 8, wherein the joint includes a plate adapted to bolt to the load and said joint connecting the plate to the arm wherein the joint includes a pinned planar connection where rotation of the joint about a long axis of said arm allows the weight of the load to pivot about said pinned planar connection such that a first axis of said load rotates from a first position perpendicular to a length of said arm to a second position where said load is under said arm and said first axis is parallel to said length of said arm.

10. The lift as recited in claim 9, wherein said space actuators include a first actuator to lift and lower said arm and a second actuator to pivot said arm raising and lowering said load.

11. The lift as recited in claim 9, wherein the wheeled base includes a pair of legs, each leg carrying a wheel and each leg being pivotable from a first position where a length of the leg is parallel to a length of said arm to a second position where said wheel is spaced further from said arm.

12. The lift as recited in claim 10, wherein said first actuator is a screw lift and said second actuator is a powered cylinder pivotally connected to said arm.

13. The lift as recited in claim 11, wherein said wheel includes an opening that allows the wheel to be steered using a bar.

14. The lift as recited in claim 10, wherein said shaft rotation is controlled by a manual crank and wherein the load is a manway cover.

15. A lift for maneuvering a load, the lift including:

a mobile base;

an arm adapted to connect to a load;

at least two actuators connecting said arm to said base;

a joint rotatably held by said arm;

a crank connected to said joint to rotate said joint;

a pivotable connection on an end of said joint;

wherein said joint having a first position wherein said load is held against rotation and, a second position wherein the weight of said load allows said load to pivot under said arm.

16. The lift as recited in claim 15, wherein the joint includes a plate adapted to connect to the load and said joint connecting the plate to the arm wherein the joint includes a rotatable planar connection where rotation of the joint in a first direction about a long axis of said arm allows the weight of the load to pivot about said rotatable planar connection such that a first axis of said load rotates from a first position perpendicular to length of said arm to a second position where said load is under said arm and said first axis is parallel to said length of said arm and wherein rotating the joint in the opposite direction returns the load.

17. The lift as recited in claim 16, wherein said at least two actuators include a first actuator to lift and lower said arm and a second actuator to pivot said arm raising and lowering said load.

18. The lift as recited in claim 17, wherein the mobile base includes a pair of legs, each leg carrying a wheel and each leg being pivotable from a first position where the wheel is closer to said arm to a second position where said wheel is spaced further from said arm.

19. The lift as recited in claim 18, wherein said first actuator is a screw lift and said second actuator is a powered cylinder pivotably connected to said arm and wherein said wheel includes an opening that allows steering of the wheel using a bar.

20. The lift as recited in claim 19, wherein said shaft rotation is controlled by a manual crank and wherein the load is a manway cover.

* * * * *